US008695698B2

(12) United States Patent
Noel

(10) Patent No.: US 8,695,698 B2
(45) Date of Patent: Apr. 15, 2014

(54) EXPANSION SYSTEM FOR EXPANDABLE TUBULARS

(75) Inventor: Gregory Marshall Noel, Katy, TX (US)

(73) Assignee: Enventure Global Technology, L.L.C., Houston, TX (US)

( * ) Notice: Subject to any disclaimer, the term of this patent is extended or adjusted under 35 U.S.C. 154(b) by 717 days.

(21) Appl. No.: 12/622,935

(22) Filed: Nov. 20, 2009

(65) Prior Publication Data

US 2011/0120700 A1 May 26, 2011

(51) Int. Cl.
*E21B 23/00* (2006.01)

(52) U.S. Cl.
USPC ..... 166/207; 166/384; 166/208

(58) Field of Classification Search
USPC ..... 166/380, 384, 277, 207, 212, 208
See application file for complete search history.

(56) References Cited

U.S. PATENT DOCUMENTS

| | | | | |
|---|---|---|---|---|
| 3,477,506 | A * | 11/1969 | Malone | 166/207 |
| 6,497,289 | B1 | 12/2002 | Cook | |
| 7,048,067 | B1 * | 5/2006 | Cook et al. | 166/380 |
| 7,063,149 | B2 | 6/2006 | Simpson et al. | |
| 7,100,684 | B2 * | 9/2006 | Cook et al. | 166/207 |
| 7,357,188 | B1 | 4/2008 | Cook | |
| 7,363,984 | B2 | 4/2008 | Brisco | |
| 7,367,389 | B2 * | 5/2008 | Duggan et al. | 166/207 |
| 7,383,889 | B2 * | 6/2008 | Ring et al. | 166/382 |
| 7,506,687 | B2 * | 3/2009 | Ring | 166/207 |
| 2004/0154800 | A1 | 8/2004 | Simpson et al. | |
| 2009/0308594 | A1 | 12/2009 | Lohbeck | |
| 2010/0193199 | A1 | 8/2010 | Lohbeck | |

FOREIGN PATENT DOCUMENTS

| | | |
|---|---|---|
| WO | 2011063170 | 5/2011 |

OTHER PUBLICATIONS

Search Report dated May 27, 2011 for corresponding International Application No. PCT/US2010/057321 (8 pgs.).
Written Opinion dated May 27, 2011 for corresponding International Application No. PCT/US2010/057321 (3 pgs.).
International Report of Patentability dated May 22, 2012 for corresponding International Application No. PCT/US2010/057321 (4 pgs.).

* cited by examiner

*Primary Examiner* — Daniel P Stephenson
*Assistant Examiner* — Kipp Wallace
(74) *Attorney, Agent, or Firm* — Derek V. Forinash; Porter Hedges LLP

(57) ABSTRACT

Methods and apparatus for radially expanding and plastically deforming an expandable tubular include a resilient launcher. The resilient launcher includes a launcher portion and a sleeve portion. An inner diameter of the sleeve portion is smaller than an inner diameter of the launcher portion. An expansion cone is disposed in the launcher portion of the resilient launcher. The expandable tubular is disposed around the sleeve portion and above the launcher portion of the resilient launcher. The launcher portion comprises a port that is sealable below the expansion cone.

13 Claims, 3 Drawing Sheets

EXPANSION SYSTEM FOR EXPANDABLE TUBULARS

BACKGROUND

In the oil and gas industry, expandable tubing is often used for casing, liners and the like. To create a casing, for example, a tubular member is installed in a wellbore and subsequently expanded by displacing an expansion cone through the tubular member. The expansion cone may be pushed or pulled using mechanical means, such as by a support tubular coupled thereto, or driven by hydraulic pressure. As the expansion cone is displaced axially within the tubular member, the expansion cone imparts radial force to the inner surface of the tubular member. In response to the radial force, the tubular member plastically deforms, thereby permanently increasing both its inner and outer diameters. In other words, the tubular member expands radially. Expandable tubulars may also be used to repair, seal, or remediate existing casing that has been perforated, parted, corroded, or otherwise damaged since installation.

DETAILED DESCRIPTION

The present disclosure relates to apparatus and methods for expanding a tubular within a wellbore. More specifically, the apparatus includes a resilient launcher with an expansion cone for expanding the tubular within the wellbore.

Figure 1A:
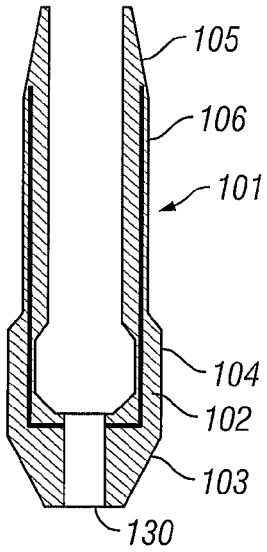
FIG. 1A is a cross-section of a resilient launcher in accordance with one embodiment.

Referring to FIGS. 1A-1E, cross-sections of components of an expansion apparatus in accordance with one embodiment are shown. FIG. 1A is a cross-section of a resilient launcher 101. The resilient launcher 101 is formed from a resilient material, such as polyurethane. The resilient launcher 101 includes a launcher portion 104 and a sleeve portion 106. The launcher portion 104 has a larger inner diameter than the sleeve portion 106 in order to accommodate an expansion cone 110, shown in FIG. 1B. The lower end of the launcher portion may include a guide nose 103 to aid passage through the wellbore and a port 130 to allow fluid passage through the resilient launcher 101. At the upper end, the resilient launcher may include a connection 105 to connect with additional resilient sleeves 201, as shown in FIG. 2.

The resilient launcher is configured to withstand internal pressure sufficient to hydraulically drive the expansion cone 110. The pressure necessary varies according to the mechanical properties and the diameter of the tubular being expanded, among various other factors. For an expansion process driven by hydraulic forces with little or no mechanical force applied, the pressure during expansion may range from about 1,000 psi to about 7,000 psi, with the primary factor being the diameter of the tubular being expanded. To withstand higher pressures, the resilient launcher 101 may include mechanical reinforcement 102, which may be, for example, carbon fiber, steel, fabric, and/or a mesh of fiber or metal.

Figure 1B:
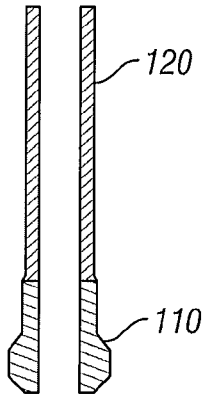
FIG. 1B is a cross-section of an expansion cone for use with the resilient launcher in FIG. 1A in accordance with one embodiment.
Figure 1C:
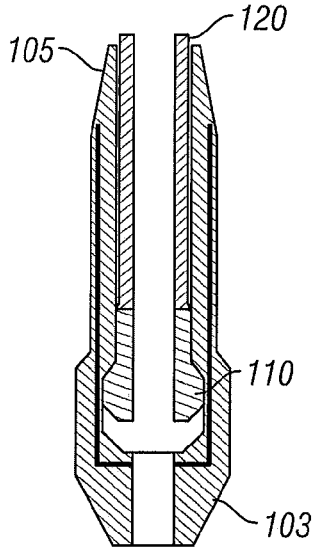
FIG. 1C is a cross-section of an expansion apparatus including the expansion cone of FIG. 1B and the resilient launcher of FIG. 1A in accordance with one embodiment.

The assembly of the expansion apparatus is illustrated in FIGS. 1A-1E. In FIG. 1B, the expansion cone 110 is connected to a support member 120, which will connect to a work string during the expansion process. The work string may be, for example, drill pipe or coiled tubing. As shown in FIG. 1C, the expansion cone 110 is forced through the sleeve portion 106 and into the launcher portion 104. The sleeve portion 106 is sufficiently flexible to elastically stretch to accommodate the expansion cone 110. In another embodiment, the resilient launcher 101 may be manufactured with the expansion cone 110 already disposed in the launcher portion 104 rather than inserted later.

Figure 1D:
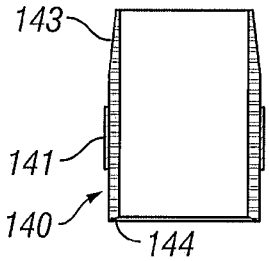
FIG. 1D is a cross-section of an expandable tubular in accordance with one embodiment.
Figure 1E:
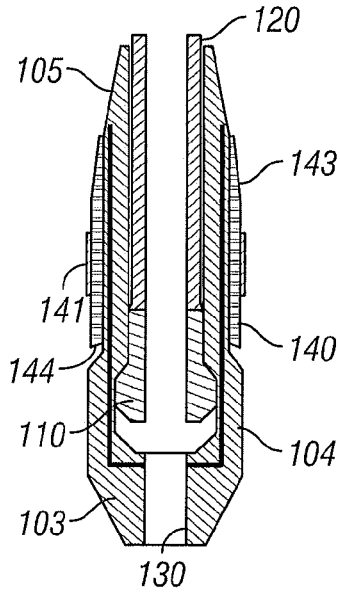
FIG. 1E is a cross-section of the expandable tubular of FIG. 1D after placement on the expansion apparatus of FIG. 1C.
Figure 2:
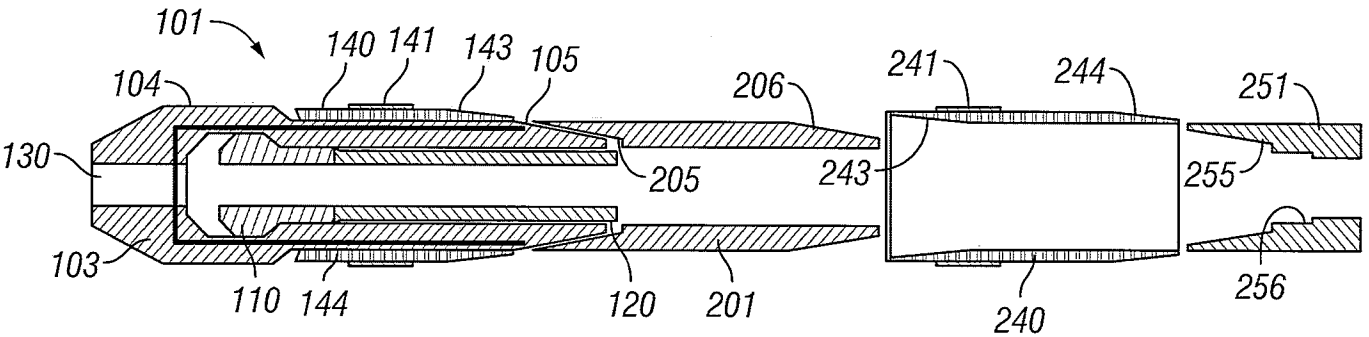
FIG. 2 is a cross-section of an expansion apparatus with multiple expandable tubulars in accordance with one embodiment.

Before or after placement of the expansion cone 110, an expandable tubular 140 shown in FIG. 1D is placed around the sleeve portion 106 above the launcher portion 104, as shown in FIG. 1E. The expandable tubular 140 may include one or more sealing elements 141 for providing a seal against the inside of an existing casing or wellbore after the expansion process. The lower end 144 of the expandable tubular 140 may include a chamfer or round to avoid cutting the resilient launcher 101 as the expansion cone 110 moves upward during the expansion process. To maintain the expandable tubular 140 in a desired axial position on the sleeve portion 106, the inner diameter of the expandable tubular 140 may have a smaller diameter than the outer diameter of the sleeve portion 106 to provide a pressure fit. Alternatively, or additionally, the inside of the expandable tubular 140 and/or the outside of the sleeve portion 106 may have ribs or other surface features to maintain their relative axial position while being placed in the wellbore. In one embodiment, an adhesive may be applied to the inside of the expandable tubular 140 and/or the outside of the sleeve portion 106.

Turning to FIG. 2, the expandable tubular 140 may further include an upper connection 143 for connecting to another expandable tubular 240, which has a corresponding lower connection 243. The additional expandable tubular 240 may also include a sealing element 241 and an upper connection 244 for connecting to additional expandable tubulars. The resilient launcher 101 may also include an upper connection 105 for connecting to a lower connection 205 of another resilient sleeve 201, which will expand the additional expandable tubular 240. The upper and lower connections 105, 205 may be threaded in one embodiment. In another embodiment, the upper and lower connection 105, 205 may be complimentary frustoconical surfaces that are bonded by an adhesive or by heating until partially melting the complimentary frustoconical surfaces.

The additional expandable tubular 240 may further include an upper connection 206 that connects to a lower connection 255 of an end piece 251. The end piece 251 includes an expansion cone catch 256 that will catch the expansion cone 110 after expanding the expandable tubulars 140, 240. The expansion cone catch 256 may be a shoulder or other restriction that prevents further upward axial movement of the expansion cone 110 relative to the end piece 251. In another embodiment, the shoulder 256, or other restriction may be formed integrally within the uppermost expansion sleeve 201. When the expansion cone 110 contacts the expansion cone catch 256, pulling upward on the expansion cone 110 via the support member 120 and the work string will pull the resilient launcher 101 and any other connected resilient sleeves upward to be removed from the wellbore while leaving the expanded tubulars in place. This allows for the expansion process and removal of the entire expansion apparatus in a single trip. Alternatively, without an expansion cone catch 256, the resilient launcher 101 and any other connected resilient sleeves may be left in place and drilled out afterwards.

Figure 3A:
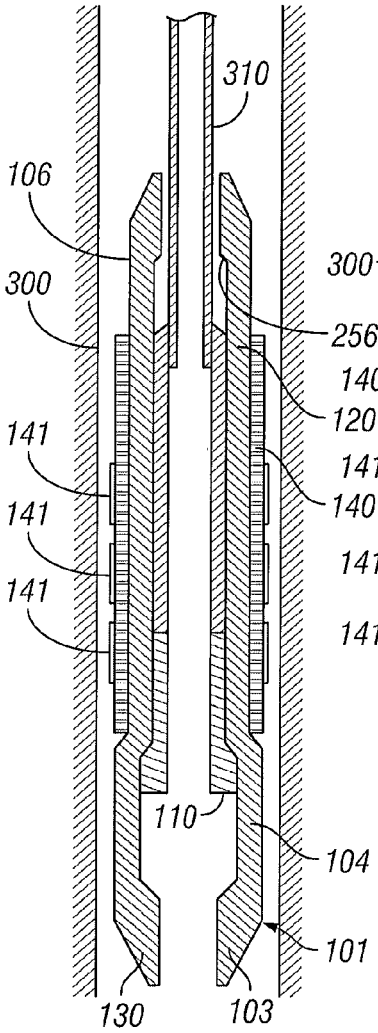
FIGS. 3A-3C are cross-sections of an expansion apparatus at various steps in an expansion process in accordance with one embodiment.
Figure 3B:
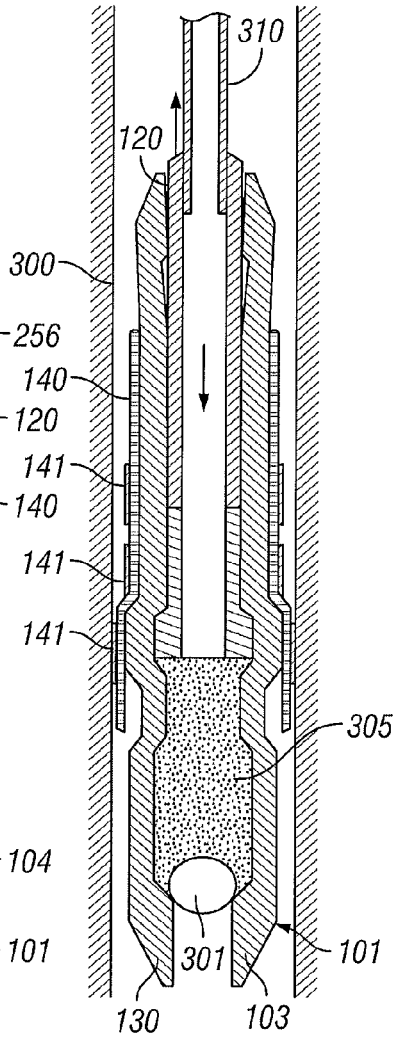
Figure 3C:
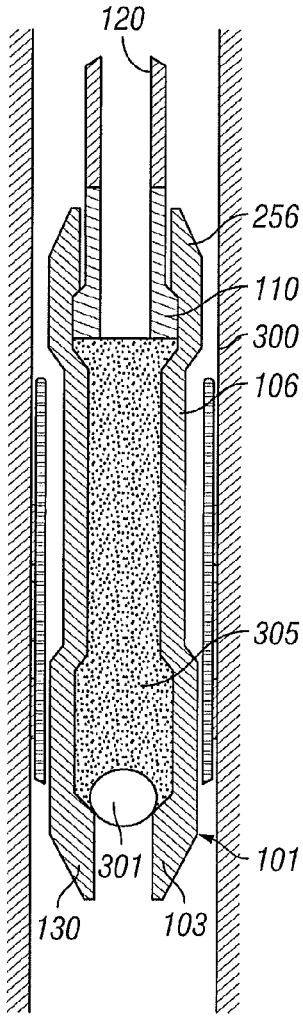

In FIGS. 3A-3C, an expansion process using a resilient launcher 101 in accordance with one embodiment is shown. In FIG. 3A, the resilient launcher 101 is positioned inside the wellbore 300 at the end of the work string 310. The wellbore 300 may be cased or open. While being positioned, fluid, such as drilling mud, may be circulated through the port 130 in resilient launcher 101. In the embodiment shown in FIG. 3A, the resilient launcher 101 is configured to expand a single section of expandable tubular 140 without additional resilient sleeves and expandable tubulars as in FIG. 2. This embodiment is particularly suited for patching an existing cased wellbore. After being positioned, fluid may continue to be pumped from the surface through the port 130 into the wellbore 300. The fluid may be cement or other hardenable fluid.

Once the desired fluids are pumped through the port 130, a wiper dart or ball 301 may be dropped from the surface to clean the fluid and plug the port 130 to allow pressure to build in the launcher portion 104 below the expansion cone 110, as shown in FIG. 3B. Continuing to pump fluid 305 drives the expansion cone 110 upward into the sleeve portion 106 of the resilient launcher 101, which radially expands the expandable tubular 140 into contact with wellbore 300. The hydraulic expansion may be assisted by mechanically pulling upward on the expansion cone 110 from the surface via the work string 310. After the expansion cone 110 axially clears the now expanded tubular 140, the expansion cone 110 catches on the expansion cone catch 256, as shown in FIG. 3C. After catching the expansion cone 110, the work string 310 may be pulled upward to retrieve the expansion cone 110 and the resilient launcher 101.

In another embodiment, the expansion cone may be expandable. By using an expandable expansion cone, the expandable tubular may be expanded to a greater diameter while being able to pass through restrictions in the wellbore. The expandable expansion cone may be expanded within the launcher portion of the resilient launcher below the expandable tubular. Actuation of the expandable expansion cone may be carried out hydraulically because the launcher portion made of resilient material requires less force to expand than the metal launchers known in the prior art.

Embodiments of the disclosure allow for hydraulically driven expansion of an expandable tubular in a wellbore using resilient sleeves to expand the expandable tubular to a greater diameter than the outside diameter of the expansion cone. This arrangement allows for a mechanically simple expansion apparatus that has a small pre-expansion outer diameter relative to the inner diameter of the post-expansion tubular. Accordingly, such an expansion apparatus can be deployed below wellbore restrictions while being able to expand the inner diameter of the expandable tubular to be equal or greater than the inner diameter of the wellbore restriction or existing liners.

By driving the expansion process hydraulically, the expansion apparatus disclosed herein may be deployed using smaller rigs because of the low mechanical loads needed for the work string. Additionally, the work string may be tubing instead of drill pipe because of the reduced need for mechanical pull via the work string. This capability allows for the expansion apparatus disclosed herein to be deployed to a wider range of wells.

Although this detailed description has shown and described illustrative embodiments of the invention, this description contemplates a wide range of modifications, changes, and substitutions. In some instances, one may employ some features of the present invention without a corresponding use of the other features. Accordingly, it is appropriate that readers should construe the appended claims broadly, and in a manner consistent with the scope of the invention.

What is claimed is:

1. An apparatus for radially expanding and plastically deforming an expandable tubular member, comprising:

a resilient launcher comprising a launcher portion and a sleeve portion, wherein an inner diameter of the sleeve portion is smaller than an inner diameter of the launcher portion;

an expansion cone coupled to a support member and disposed in the launcher portion of the resilient launcher, wherein the support member and expansion cone include a conduit for supplying fluid to the launcher portion of the resilient launcher;

an expandable tubular disposed around the sleeve portion and above the launcher portion of the resilient launcher;

a port disposed in the launcher portion of the resilient launcher, wherein the port is closed so that fluid supplied through the support member and the expansion cone drives the expansion cone through the sleeve portion or the resilient launcher so as to radially expand the expandable tubular; and an expansion cone catcher disposed in the sleeve portion above the expandable tubular and operable to prevent upward movement of the expansion cone relative to the resilient launcher.

2. The apparatus of claim 1, further comprising:

an expansion sleeve coupled to the sleeve portion; and a second expandable tubular disposed around the expansion sleeve.

3. The apparatus of claim 1, wherein the resilient launcher comprises polyurethane.

4. The apparatus of claim 3, wherein at least the launcher portion of the resilient launcher is reinforced by an internal mesh of a second material.

5. The apparatus of claim 1, wherein the expansion cone is expandable.

6. The apparatus of claim 5, wherein the expansion cone expands in response to hydraulic pressure.

7. The apparatus of claim 1, wherein the expandable tubular and the sleeve portion of the resilient launcher are bonded together by an adhesive.

8. The apparatus of claim 1, wherein the outer diameter of the launcher portion is less than the inner diameter of the expandable tubular once the expansion cone has passed through the expandable tubular.

9. A method comprising:

locating an expansion apparatus in a wellbore at the end of a work string, wherein the expansion apparatus comprises, a resilient launcher comprising a launcher portion and a sleeve portion, wherein an inner diameter of the sleeve portion is smaller than an inner diameter of the launcher portion, an expansion cone disposed in the launcher portion of the resilient launcher, and an expandable tubular disposed around the sleeve portion and above the launcher portion of the resilient launcher;

closing a port in the launcher portion of the resilient launcher below the expansion cone;

pumping fluid into the launcher portion of the resilient launcher below the expansion cone to drive the expansion cone upward into the sleeve portion of the resilient launcher and expand the expandable tubular;

catching the expansion cone at an upper end of the expansion apparatus; and pulling upward on the work string to remove the expansion apparatus from the wellbore without the expandable tubular.

10. The method of claim 9, further comprising:

expanding the expansion cone inside the launcher portion of the resilient launcher.

11. A method comprising:

disposing an expansion cone within a resilient launcher that is coupled to an expandable tubular to form an expansion apparatus;

coupling a work string to the expansion cone so as to support the expansion apparatus;

positioning the expansion apparatus a wellbore;

closing a port disposed at a lower end of the resilient launcher;

pumping fluid through the work string and into the resilient launcher so as to axially move the expansion cone, wherein axial movement of the expansion cone through a sleeve portion of the resilient launcher radially expands the expandable tubular;

pulling the work string from the wellbore so as to remove the expansion cone and the resilient launcher from the expandable tubular, the removal of the resilient launcher from the wellbore being allowed for by engagement of the expansion cone with a cone catcher coupled to an upper end of the resilient launcher.

12. The method of claim 11, wherein the port is closed by dropping a ball or dart.

13. The method of claim 11, further comprising pumping a fluid through the work string and the port before the port is closed.

* * * * *